United States Patent [19]

Kuwahara et al.

[11] Patent Number: 4,701,301

[45] Date of Patent: Oct. 20, 1987

[54] PROCESS FOR PRODUCING AN INTERNAL-OXIDIZED ALLOY OR A SHAPED ARTICLE THEREOF

[75] Inventors: Hideyuki Kuwahara, Nagaokakyo; Bunji Kondo; Jun Takada, both of Kyoto; Kenji Yanagihara; Mituo Kimura, both of Yokohama; Masahiro Niinomi, Machida, all of Japan

[73] Assignees: Japan Synthetic Rubber Co., Ltd., Tokyo; Applied Science Research Institute, Kyoto, both of Japan

[21] Appl. No.: 886,039

[22] Filed: Jul. 16, 1986

[30] Foreign Application Priority Data

Jul. 26, 1985 [JP] Japan ..... 60-163958

[51] Int. Cl.[4] ..... B22F 1/00

[52] U.S. Cl. ..... 419/21; 419/19; 75/10.19; 148/431; 420/129; 420/590; 427/38; 427/39

[58] Field of Search ..... 75/10.19, 10.2, 10.21, 75/10.22; 148/431; 420/129, 590; 419/19, 35, 63, 64, 21; 427/38, 39

*Primary Examiner*—Sam Silverberg
*Assistant Examiner*—Terry J. Owens
*Attorney, Agent, or Firm*—Oblon, Fisher, Spivak, McClelland & Maier

[57] ABSTRACT

A process for producing an internal-oxidized alloy, which comprises allowing a plasma generated in the presence of oxygen, a gas of an oxygen atom-containing compound or a mixture of oxygen and a gas of an oxygen atom-containing compound to act on an alloy consisting of at least two metal elements, thereby selectively oxidizing at least one metal element other than the matrix metal in said alloy. Particles of the internal-oxidized alloy thus obtained can, if necessary, be molded into a desired shape and sintered. Said process enables one to produce an internal-oxidized alloy at a high speed at a temperature of not more than 0.9 Tm (Tm: the melting point of the starting alloy) and does not require the step of separating an internal-oxidizing agent which step is required in the conventional process.

10 Claims, 7 Drawing Figures

PROCESS FOR PRODUCING AN INTERNAL-OXIDIZED ALLOY OR A SHAPED ARTICLE THEREOF

BACKGROUND OF THE INVENTION

1. Field of the Invention

This invention relates to a process for producing an internal-oxidized alloy or a shaped article thereof.

2. Description of the Prior Art

For the production of internal-oxidized alloys, the following process has heretofore been known: At least two metals are mixed by, for example, a melting method to obtain an alloy consisting of a matrix metal having contained therein at least one other metal in a total amount of not more than 20% by weight based on the weight of the alloy; the alloy is contacted, at its outside, with a metal oxide powder as an internal-oxidizing agent; and in this state, the alloy is heated to a temperature close to the melting point of the matrix metal to selectively oxidize only at least one metal other than the matrix metal present in the interior of the alloy (this treatment is referred to hereinafter as selective oxidation treatment).

The internal-oxidized alloy thus obtained contains a high-strength metal oxide (or metal oxides) in the form of fine particles in the matrix metal, and the fine particles of metal oxide(s) prevent the progress of rearrangement. Therefore, the internal-oxidized alloy, has an increased tensile strength as compared with the alloy before the selective oxidation treatment, and this high strength is retained even at high temperatures close to the melting point of the matrix metal. Because of these excellent characteristics, attention is drawn to the internal-oxidized alloy particularly as a material requiring both mechanical strength and heat resistance, such as dies for rubbers and plastics, turbine blades, electrical contacts and the like.

Such internal-oxidized alloys have the characteristics of the matrix metal as such together with excellent mechanical strength and heat resistance as discussed above, and hence, the characteristics of the matrix metal can be utilized as such. Therefore, various applications of the alloys are expected. Specifically, an internal-oxidized alloy obtained from an alloy in which the matrix metal is copper has a high electric conductivity and thermal conductivity which is equivalent to copper and simultaneously has an excellent dynamic strength and heat resistance. Therefore, said internal-oxidized alloy is expected to be used as a high temperature-resistant, electrically conductive material, a heat-sink material or the like.

The conventional process for producing an internal-oxidized alloy, however, has the following disadvantages: (1) In the selective oxidation treatment, it is necessary to heat the starting alloy to a temperature close to the melting point of the matrix metal from the exterior, and hence, the energy efficiency is low, the production cost is high, and the process is disadvantageous in mass production.

(2) The selective oxidation treatment utilizes the release of oxygen due to the thermal reaction of a metal oxide power which is an internal-oxidizing agent and diffusion of the released oxygen into the interior of the alloy material. Accordingly, direct control of the oxidation reaction is difficult, and the rate of the oxidation reaction is very low. In addition, the diffusion of the released oxygen into the interior of the alloy material governs the rate of oxidation reaction. Therefore, a long period of time is required to internal-oxidize a large size of alloy, and in many cases, the internal oxidation is actually impossible.

(3) After the selective oxidation treatment, it is necessary to separate the internal-oxidized alloy from the powder of internal-oxidizing agent. The starting alloy can be used in the form of particles which can be effected in a high rate in the selective oxidation treatment, and the alloy particles can be subjected to selective oxidation treatment, followed by molding and sintering the resulting internal-oxidized alloy in the form of particles to obtain molded articles of the internal-oxidized alloy. In this case, however, both the internal-oxidized alloy and the internal-oxidizing agent are in the form of particles, and hence, separation of the internal-oxidized alloy from the internal-oxidizing agent after the selective oxidation treatment is very difficult.

SUMMARY OF THE INVENTION

An object of this invention is to provide a process for producing an internal-oxidized alloy, by which an alloy consisting of at least two metal elements can be selectively oxidized at a high rate, the selective oxidation treatment can be controlled at a high degree of freedom and accordingly the internal-oxidized alloy having the desired characteristics can be obtained easily.

Another object of this invention is to provide a process by which a shaped article of an internal-oxidized alloy can be produced easily regardless of its size.

According to this invention, there is provided a process for producing an internal-oxidized alloy, which comprises allowing a plasma generated in the presence of oxygen, a gas of an oxygen atom-containing compound or a mixture of oxygen and a gas of an oxygen atom-containing compound (hereinafter, the oxygen, the gas of an oxygen atom-containing compound and the mixture are collectively referred to as "an oxygen-containing gas" and the plasma is referred to as "oxygen-containing plasma") to act on an alloy consisting of at least two metal elements, thereby selectively oxidizing at least one metal element other than the matrix metal in the alloy.

BRIEF DESCRIPTION OF THE DRAWINGS

In the accompanying drawings.

DETAILED DESCRIPTION OF THE INVENTION

Figure 1:
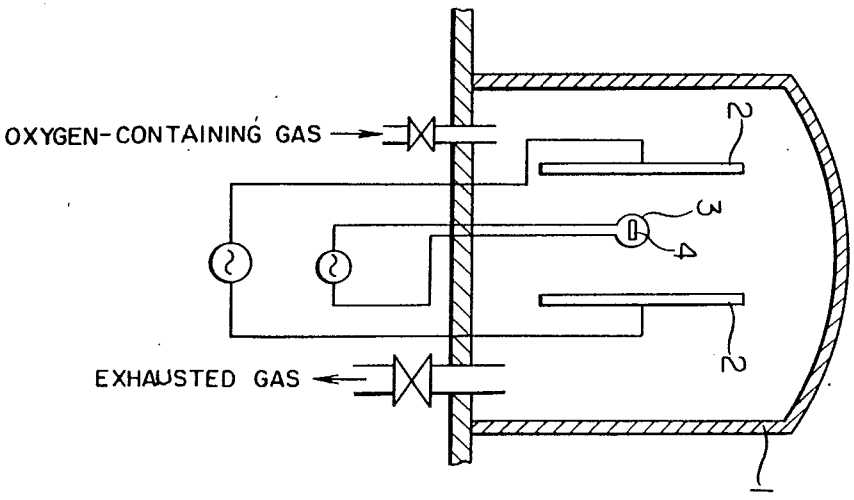
FIG. 1 shows an example of the reactor used in this invention.

In this invention, an oxygen-containing plasma is allowed to act on the starting alloy to be converted into an internal-oxidized alloy. This starting alloy can be prepared by a melting method, a sputtering method or the like. The method for the preparation of an alloy is not critical. Also, when an alloy in the form of particles is intended to be prepared, an alloy block prepared by the above method can be subjected to mechanical grinding, electrical dispersion, atomization, vacuum vaporization, gas reduction, liquid phase reduction, electrolysis or the like, to prepare the alloy in the form of particles. As the metal elements system constituting the starting alloy for internal-oxidized alloy, the following systems forming a solid solution, an eutectic mixture or the like can be used, wherein each metal in brackets is a matrix metal, and a metal or metals following the matrix metal are a metal or metals other than the matrix metal:

| | |
|---|---|
| [Ag] | Al, As, Au, Be, Bi, Ca, Cd, Ce, Cu, Dy, Er, Eu, Ga, Gd, Ge, Hg, Ho, In, La, Li, Lu, Mg, Mn, Na, Nb, Ni, Pb, Pd, Pr, Pt, Pu, Sb, Sc, Sm, Sn, Sr, Tb, Te, Th, Ti, Tl, Tm, Yb, Zn and Zr. |
| [Am] | Pu |
| [Al] | Ca and Mg |
| [As] | Eu, Ge, Nb, Sn and Te |
| [At] | Cb, Ce, Dy, Er, Ga, Gd, Ge, Hg, Ho, La, Lu, Nb, Pb, Pr, Pu, Ru, Sc, Se, Sm, Tb, Th, Tm, V and Yb |
| [Au] | Al |
| [B] | Al, Cb, Ce, Dy, Er, Gd, Hf, Ho, La, Lu, Mn, Mo, Nb, Pm, Pr, Pt, Re, Rh, Ru, Sc, Si, Sm, Ta, Tb, Th, Ti, Tm, V, W, Y, Yb and Zr |
| [Ba] | Al, Be, Cd, Cu, Ga, Ge, Hg, In, Ni, Pb, Pd, Se, Tl, Eu, Nb and Yb |
| [Be] | Ca, Cb, Cd, Mg and Sr |
| [Bi] | Dy, Gd, Hf, In, Ir, La, Lu, Mn, Na, Nb, Pb, Pr, Pu, Y and Yb |
| [Cb] | Co, Ga, Hf, Mg, Mo, Sb, Sm and Zn |
| [Cd] | Al, Ca, Ce, Eu, La, Nb, Np, Pr, Sm, Sr, Ti and Yb |
| [Ce] | Cr, Cu, Eu, Ga, Ge, In, Ir, Mg, Ni, Pd, Sb, Se, Si, Sm, Tb, Te, Ti, Tl and Zr |
| [Co] | Al, Dy, Er, Ga, Gd, Hf, Ho, In, La, Lu, Mn, Nb, Pr, Se, Sm, Ta, Tb, Te, Th, Y, Yb and Zr |
| [Cr] | Al, Ga, Ge, Hf, Ho, Ir, Lu, Mo, Nb, Pr, Pt, Rh, Si, Se, Sl, Sm, Ta, Tb, Ti, Tm and V |
| [Cs] | In and Tl |
| [Cu] | Al, Ca, Er, Hf, Hg, Ir, La, Rh, Sc, Se, Sr, Th, Ti, V, Yb and Si |
| [Dy] | Al, Fe, Ca, Mg, Mn, Nb, Pb, Pd, Pu, Ru, Sb, Te, Th, Tl, Y and Zr |
| [Er] | Al, Fe, Ga, Hf, Hg, Mg, Mn, Nb, Ni, Pt, Pu, Re, Rh, Sc, Se, Te, Th, Tl, V and Zr |
| [Eu] | Al, Ca, Ga, Ho, In, Mg, Ni, Pb, Pd, Te, Th and Yb |
| [Fe] | Al, Ga, Gd, Ge, Ho, In, Ir, Lu, Mg, Mo, Nb, Os, Pd, Pr, Se, Sc, Si, Sm, Tb, Tc, Te, Th, Ti, Tm, Yb and Zn |
| [Ga] | Al, Ca, Gd, Ho, K, La, Lu, Mo, Nb, Pm, Pr, Pt, Sc, Se, Sm, Tm, U and Y |
| [Gd] | Al, Ge, Hg, Mg, Nb, Pu, Te, Re, Rh, Ru, Sb, Tb, Te, Th, Tl, Yb and Zr |
| [Ge] | La, Li, Nb, Pd, Pr, Pt, Rb, Re, Se, Sm, Sr, V, W and Y |
| [Hf] | Al, Ir, K, Li, Mn, Mo, Ni, Pd, Pu, Ru, Si, Sn, Ti and V |
| [Ni] | Al, Ca, Os, Rh, Se, Sr, Tc, Te, Th, Ti, V, W, Yb and Zr |
| [Si] | Al and Ti |
| [Ti] | Al |

The particularly preferable combinations of metals for alloys are as follows:

| | |
|---|---|
| [Ag] | Al, Bi and Cd, |
| [Cu] | Al, Si and Ti |
| [Fe] | Si, Mo and Ti |
| [Ni] | Th, Os and Ti |

In order to produce the internal-oxidized alloy having excellent characteristics, it is essential that the starting alloy contains the metal elements(s) other than the matrix metal in a total amount of 20 ppm to 20% by weight based on the weight of the alloy. When the metal element(s) other than the matrix metal is (are) contained in a total amount of less than 20 ppm, the degree of improvement in strength and heat resistance due to the oxides in the interior of the alloy is too small. When the metal element(s) other than the matrix metal is (are) contained in a total amount exceeding 20% by weight, the selective oxidation treatment of the metal element(s) other than the matrix metal is difficult and the matrix metal becomes oxidized, too.

The selective oxidation treatment by the oxygen-containing plasma is usually conducted under the following conditions:

The oxygen-containing gas includes $O_2$, $CO_2$, $NO_2$, $N_2O_3$, $N_2O_4$, $N_2O_5$, $SO_2$, $SO_3$, $TeO_2$, $TeO_3$, $SeO_2$, $SeO_3$, $P_4O_{10}$, $P_4O_6$, $As_2O_5$, $As_4O_6$, $Sb_2O_5$, $Sb_4O_6$, $Bi_2O_5$, $Bi_4O_6$, $H_2O$, etc. To the oxygen-containing gas may be added a rare gas (e.g., He, Ar, Xe or the like) or a gas of $H_2$, $N_2$, $B_2$ or the like as a carrier gas.

The degree of vaccum in the space in which a plasma is to be generated (hereinafter referred to as the plasma-generating space) is preferably $1\times10^{-5}$ to 100 Torr, more preferably $1\times10^{-5}$ to 10 Torr. When the degree of vacuum is less than $1\times10^{-5}$ Torr or exceeds 100 Torr, it is difficult to generate a plasma stably and uniformly. Under such conditions, the partial pressure of the oxygen-containing gas is preferably $1\times10^{-5}$ Torr to 10 Torr, more preferably $1\times10^{-5}$ to 1 Torr. When the partial pressure of the oxygen-containing gas is less than $1\times10^{-5}$ Torr, the rate of the selective oxidation is very low. When the partial pressure exceeds 10 Torr, there is a fear that the matrix metal may be oxidized.

The means, embodiment, apparatus and the like for generating an oxygen-containing plasma are not critical. For example, the reactor may be of a bell-jar type, a tubular flow type or the like; the type of discharge may by any of direct current discharge, low frequency discharge, high frequency discharge, microwave discharge, cathode-heating discharge, etc.; the type of electrodes may be a parallel plates type, a coil type (in the case of high frequency discharge) or a hollow cathode type. In the case of microwave discharge, the electrode type may be of a cavity type coupling or a ladder type coupling. Examples of the coil type electrodes include cylindrical electrodes, square pillar-shaped electrodes and flat electrodes.

In carrying out the present process, the oxygen-containing plasma has a positive ion density falling preferably within the range of $10^5$ to $10^{12}$ positive ions/cm$^3$, particularly preferably within the range of $10^5$ to $10^9$ positive ions/cm$^3$. When the positive ion density is less than $10^5$ positive ions/cm$^3$, the rate of selective oxidation becomes about equal to that in the conventional process but the effect of this invention is not sufficient. When the positive ion density exceeds $10^{12}$ positive ions/cm$^3$, only the surface of the starting alloy is excessively heated by the oxygen-contaning plasma and deformation of the alloy and reduction in uniformity of internal oxidation occur in some cases. When induction heating as described hereinafter is not effected, the positive ion density is particularly preferably not more than $10^9$ positive ions/cm$^3$ in order to prevent the reduction in uniformity of internal oxidation. Incidentally, the positive ion density can be measured by, for example, a probe method or a microwave method (refer to "Physics Review" (1950), 80, 58; "Journal of Applied Physics" (1962), 33, 575; and "RCA Review" (1951), 12, 191). Controlling the positive ion density so as to fall within a range of $10^5$ to $10^{12}$ positive ions/$cm^3$ is very easy, and specifically, a preferable means can be selected from means of controlling factors affecting the plasma state and the conditions under which the plasma is allowed to act, for example, (1) a means of adjusting a discharge current for generating an oxygen-containing plasma; (2) a means of adjusting the degree of vacuum in the oxygen-containing plasma generating space; (3) a means of adjusting the distance between electrodes in the case of parallel plates type electrodes; (4) a means of adjusting the flow rate of a carrier gas; (5) a means of adjusting the relative positions of the starting alloy and the electrodes or cavity; and the like.

The flow rate of the oxygen-containing gas for generating an oxygen-containing plasma is, for example, preferably 0.1 to 100 cc (STP)/min when a 150-liter plasma reactor is used. When the flow rate of the oxygen-containing gas is less than 0.1 cc (STP)/min, the rate of selective oxidation is low. When the flow rate of the oxygen-containing gas exceeds 100 cc (STP)/min, the aimed selective oxidation treatment becomes difficult and there is a fear that even the matrix metal may be oxidized.

Moreover, in the present process, the electron temperature of the oxygen-containing plasma is usually 10,000°K. to 100,000°K.

The temperature of the starting alloy when allowing an oxygen-containing plasma to act on the alloy may be any temperature not higher than the melting point of the starting alloy. The temperature is preferably 0.4 tm to 0.9 tm (Tm: the melting point of the starting alloy). When the temperature of the starting alloy exceeds 0.9 tm, deformation of the alloy and reduction in uniformity of internal oxidation occur in some cases. When the temperature is lower than 0.4 tm, the rate of selective oxidation is not sufficient.

The means of heating the starting alloy includes induction heating, heating by a heater, heating by infrared rays and the like. Of these means, induction heating is preferred.

Induction heating is one of the electrical heating methods, in which a principle is utilized that when a good conductor such as a metal is placed in an alternating magnetic field, an eddy current flows through the conductor owing to magnetic induction and a heat is generated in the conductor by the eddy current loss, wherein when the conductor is a magnetic substance, the hysteresis loss also contributes to the heat generation, whereby the conductor generates heat.

The means, embodiment and apparatus for carrying out the induction heating are not critical. For example, the frequency of the electric source may be any of a low frequency, a high frequency, a microwave and the like, but generally a frequency of 50 Hz to 3,000 MHz is preferred. A microwave can preferably be used when the starting alloy is in the form of particles.

The type of electrodes for carrying out the induction heating may be, for example, a coil type as mentioned previously but is appropriately selected depending upon the shape of the starting alloy to be internally oxidized. For example, when the starting alloy has a column shape, a cylindrical coil type electrode is preferred, and when the starting alloy has a plate shape, a flat coil type electrode is preferred. The position of the starting alloy in the reactor is usually inside the coil.

In the present process, generation of an oxygen-containing plasma and induction heating may jointly and simultaneously be conducted in the same container using one set of electrodes, or may be conducted independently or complementarily using two or more sets of electrodes simultaneously.

When a shaped article of an internal-oxidized alloy is produced according to the present process, it is preferable that the starting alloy is the form of particles is subjected to selective oxidation treatment, followed by molding and sintering the same. In this case, the starting alloy in the form of particles has preferably an average particle diameter of 50 Å to 100 μm. When the average particle diameter is less than 50 Å, the aimed oxidation of the metal elements other than the matrix metal is not performed appropriately. For example, oxide compounds are present only around the surface of alloy in the form of particles. Thus, the distribution of oxide compounds in the particles of alloy becomes uneven. Therefore, when an alloy in the form of particles is molded and sintered, the distances between the adjacent oxide compounds in the alloy become uneven, and as a result, the strengthening of the alloy due to distribution of oxide compounds is not appropriately effected, and no molded and sintered articles having good characteristics can be obtained. When the average particle diameter of particles of the starting alloy exceeds 100 μm, the metal composition ratio of the particle form alloy per se tends to become uneven owing to the difference in specific gravity between different metals, and the distribution of the oxide compounds is still uneven even after the molding and sintering of the alloy which has been subjected to selective oxidation treatment. Furthermore, sinterability after selective oxidation treatment is bad, and also, the time required for the selective oxidation treatment becomes longer.

The temperature for sintering the internal-oxidized alloy in the form of particles is usually 0.4 tm to Tm.

The present process has the following meritorious effects:

(1) An internal-oxidized alloy can be produced at a high rate at temperatures as low as not more than 0.9 tm. This is a very great advantage in view of productivity and mass production.

(2) The aimed selective oxidation treatment can be conducted without using a solid internal-oxidizing agent consisting of a metal oxide powder or the like. As a result, the internal-oxidized alloy obtained is free from contamination by the agent and retains the characteristics of the matrix metal as such. Moreover, the step of separating, after the selective oxidation treatment, the internal-oxidizing agent powder from the internal-oxidized alloy is not required and this has a very great industrial significance when the starting alloy is in the form of particles. (3) Even when the starting alloy in the form of particles is used, which is advantageous in that the selective oxidation treatment time is short, no internal-oxidizing agent remains in the particles of internal-oxidized alloy. Hence, by molding and sintering this internal-oxidized alloy, a shaped article having the desired excellent characteristics can be obtained assuredly.

(4) The oxygen-containing plasma generating conditions and the conditions under which the plasma is allowed to act on the starting alloy, for example, positive ion density, degree of vacuum and the like, can be selected in wide ranges, and the control of these conditions is easy. Consequently, the selective oxidation treatment of the starting alloy can be performed in good reproducibility.

(5) Various treatment conditions in the present process including those mentioned in above (4) can be selected each at a great degree of freedom. Therefore, the internal structure of the internal-oxidized alloy obtained can be controlled in a wide range, and an internal-oxidized alloy having the desired internal structure can be produced easily. In general, the internal structure of the internal-oxidized alloy is characterized by the average diameter D of the oxide area inside the internal-oxidized alloy and the distance λ between the adjacent oxide areas. In the conventional process, the parameter affecting the internal structure of internal-oxidized alloy is temperature only, and accordingly, it is impossible to independently vary D and λ. On the other hand, in the present process, the temperature and the plasma state (positive ion density, in particular) can be varied independently, and accordingly, D and λ can be controlled independently in a wide range. As a result, the present process enables the production of an internal-oxidized alloy having very small values of D and λ even at a temperature as low as about 0.5 tm, under which conditions no internal-oxidized alloy was impossible to produce by the conventional process.

The uses of the internal-oxidized alloy produced according to the present process are as follows:

In the field of electronic materials, there are a lead frame for IC, a contact for circuit breakers, relays, etc., a conductor for high temperatures, a conductor for electromagnetics, an electric connector, a very thin conductor and so forth. In these uses, there are preferably used internal-oxidized alloys of a copper-other metal system such as Cu-Al, Cu-Si or the like.

In the field of machines, there are shaft and a commutator for motors; a nozzle, a lance chip, a feed-through, a turbine rotor, a turbine blade, a piston, a piston ring, a cylinder and the like in heat engines; a gear, a chain, a bearing, a brake disc, an electrode for welding, a spring material and so forth. In these uses, there are used not only internally oxidized alloys of a copper-other metal system but also those of an iron-other metal system, e.g., Fe-Al, Fe-Si or the like; a cobalt-other metal system, e.g., Co-Hf, Co-Th, or the like; a chromium-other metal system, e.g., Cr-Si, Cr-Ti, or the like; and a nickel-other metal system, e.g., Ni-Al, Ni-V, or the like.

Internal-oxidized alloys of the copper-other metal system can also be used as a material for high-temperature dies for rubbers, resins, aluminum, etc.

Internal-oxidized alloys of a noble metal-other metal system, e.g., Au-Al, Ag-Al or the like can be used as an electroconductive material, a contact material, and various accessories such as ring, necklace, watch and the like.

DESCRIPTION OF PREFERRED EMBODIMENTS

Example 1 and Comparative Example 1

A plate of 50 mm in length, 2 mm in width and 100 μm in thickness, composed of a Cu-Al alloy (Al content: 0.05% by weight, melting point: 1358° K.) prepared by a melting method was used as a sample. As shown in FIG. 1, in a 150 liter bell-jar type reactor 1 was placed a heater 3 consisting of a tungsten coil at the center between two electrodes 2 of parallel plates type. The above sample 4 was kept inside the heater 3 approximately at the center of the parallel plates type electrodes 2 so that the sample 4 did not come in contact with the heater 3, and the sample 4 was maintained at 973° C. by thermal radiation heating by the heater 3.

The conditions for an oxygen-containing gas to be fed to the bell-jar type tractor 1 and the plasma-generating conditions in the reactor 1 were selected as shown in Table 1. Under these conditions, the sample was subjected to selective oxidation treatment by oxygen-containing plasma for 1 hour, whereby an internal-oxidized alloy was produced.

On these internal-oxidized alloys, the degree of internal oxidation was measured using an electron spectrocopy for chemical analysis "ESCA 750" manufactured by Shimadzu Corp., and the tensile yield strength was measured using an autograph "DSS-500!" manufactured by Shimadzu Corp. This autograph was one remodelled so as to enable high temperature heating by an infrared image furnace.

With respect to the results of the measurement by the electron spectroscopy for chemical analysis, the percentage of internal-oxidation of Al was determined by (1) separating the peak of $Al_{2s}$ by wave analysis into a peak (1139 eV) for non-oxidized Al and a peak (1136 eV) for oxidized and chemically shifted Al and (2) calculating the ratio of the respective peak areas. The percentage of internal oxidation of Cu was also determined using a peak (933 eV) for $Cu_{2p}{}^{3/2}$. Prior to the measurement by the electron spectroscopy chemical analysis, each of the internal-oxidized alloys produced was subjected to Ar ion beam etching for about 3 hours, whereby the surface of each of the alloys was etched to a depth of about 3 μm. The measurement of the tensile yield strength was conducted by fixing a sample to a chuck and then elevating the sample temperature to 400° C. The results are shown in Table 1. In Table 1, Run No. 16 is Comparative Example 1, in which no internal oxidation was conducted.

TABLE 1

| Run No. | Oxygen containing gas Kind | Oxygen containing gas Flow*1 rate | Pressure (Torr) | Dis-*2 charge current (mA) | Positive*3 ion density (positive ions/cm³) | Percentage of internal oxidation of Al (%) | Percentage of internal oxidation of Cu (%) | Tensile yield strength (kg/mm²) |
|---|---|---|---|---|---|---|---|---|
| 1 | $O_2$ | 2 | $2 \times 10^{-2}$ | 20 | $5 \times 10^6$ | 70 | 0 | 2.1 |
| 2 | $O_2$ | 2 | $2 \times 10^{-2}$ | 80 | $7 \times 10^7$ | 85 | 0 | 2.4 |
| 3 | $O_2$ | 2 | $2 \times 10^{-2}$ | 120 | $4 \times 10^8$ | 100 | 0 | 3.0 |
| 4 | $O_2$ | 2 | $2 \times 10^{-2}$ | 200 | $2 \times 10^9$ | 100 | 10 | 0.9 |
| 5 | $O_2$ | 2 | $2 \times 10^{-2}$ | 300 | $4 \times 10^9$ | 100 | 20 | 1.0 |
| 6 | $CO_2$ | 1 | $5 \times 10^{-2}$ | 15 | $4 \times 10^6$ | 75 | 0 | 2.2 |
| 7 | $CO_2$ | 1 | $5 \times 10^{-2}$ | 30 | $8 \times 10^6$ | 85 | 0 | 2.5 |
| 8 | $CO_2$ | 1 | $5 \times 10^{-2}$ | 60 | $3 \times 10^7$ | 100 | 0 | 3.0 |
| 9 | $CO_2$ | 1 | $5 \times 10^{-2}$ | 150 | $7 \times 10^8$ | 100 | 0 | 3.1 |
| 10 | $CO_2$ | 1 | $5 \times 10^{-2}$ | 300 | $4 \times 10^9$ | 100 | 15 | 1.0 |
| 11 | $NO_2$ | 1.5 | $3 \times 10^{-2}$ | 15 | $6 \times 10^6$ | 75 | 0 | 2.3 |

TABLE 1-continued

| Run No. | Oxygen containing gas Kind | Flow*1 rate | Pressure (Torr) | Dis-*2 charge current (mA) | Positive*3 ion density (positive ions/cm$^3$) | Percentage of internal oxidation of Al (%) | Percentage of internal oxidation of Cu (%) | Tensile yield strength (kg/mm$^2$) |
|---|---|---|---|---|---|---|---|---|
| 12 | $NO_2$ | 1.5 | $3 \times 10^{-2}$ | 40 | $9 \times 10^6$ | 85 | 0 | 2.6 |
| 13 | $NO_2$ | 1.5 | $3 \times 10^{-2}$ | 70 | $2 \times 10^7$ | 100 | 0 | 3.0 |
| 14 | $NO_2$ | 1.5 | $3 \times 10^{-2}$ | 100 | $1 \times 10^8$ | 100 | 0 | 3.0 |
| 15 | $NO_2$ | 1.5 | $3 \times 10^{-2}$ | 300 | $2 \times 10^9$ | 100 | 20 | 0.9 |
| 16 | — | — | — | — | — | 0 | 0 | 0.32 |

Note:
*1Unit: cc (STP)/min
*2Electric source: AC source of 20 KHz
*3Measurement was made by a probe method, and calculation was made in accordance with the Malter-Webster method ["RCA Review", (1951), 12, 191].

EXAMPLE 2

A plate of 50 mm in length, 5 mm in width and 1 mm in thickness, composed of a Fe-Si alloy (Si content: 0.3% by weight, melting point: 1808° K.) prepared by a melting method was used as an example. In the same apparatus as in Example 1 and under the conditions that the flow rate of oxygen gas was 2 cc (STP)/min, the pressure of oxygen gas was 10 mTorr, the discharge current was 80 mA and the positive ion density was $5 \times 10^7$ positive ions/cm$^3$, the same sample was subjected to selective oxidation treatment by oxygen-containing plasma for 10 hours at a temperature of 0.5 tm (904° K.), 0.6 tm (1084° K.) or 0.7 tm (1266° K.) (Tm: the melting point of the Fe-Si alloy, 1808° K.), whereby three internal-oxidized alloys were produced.

Each of the internal-oxidized alloys was cut with a diamond cutter. The cut section was polished and then observed using a metallurgical microscope at a magnification of 1,000. The internal-oxidized areas were seen as black spots, which enabled the measurement of the thickness of the internal-oxidized layer. The results are shown in Table 2.

Comparative Example 2

The same sample as in Example 2 was subjected to selective oxidation treatment for 10 hours at the same temperature as in Example 2 (0.5 tm, 0.6 tm or 0.7 tm) according to the conventional process using a $Fe_2O_3$ powder having an average particle diameter of 100 μm as an internal-oxidizing agent, whereby three internal-oxidized alloys were produced. Each of these internal-oxidized alloys was then subjected to the same evaluation as in Example 2. The results are shown in Table 2.

TABLE 2

| Temperature | 0.5 Tm | 0.6 Tm | 0.7 Tm |
|---|---|---|---|
| Example 2 | 40 μm | 100 μm | 340 μm |
| Comparative Example 2 | 1 μm | 6 μm | 17 μm |

EXAMPLE 3

Particles having an average diameter of 30 μm composed of a Cu-Al alloy (Al content: 0.03% by weight, melting point: 1358° K.) were prepared as a sample by mechanically grinding an alloy block produced by a melting method, using an eddy mill.

Figure 2:
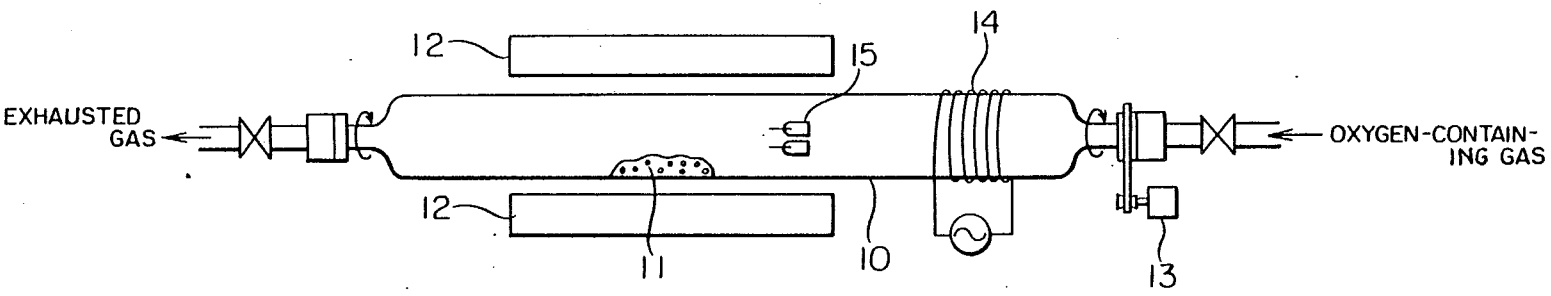
FIG. 2 shows an example of the plasma generator used in this invention.

In an introduction coupling plasma generator of tubular flow type having a constitution as shown in FIG. 2, said sample 11 was placed in a 5-liter quartz reaction tube. While the sample was kept at 973° K. by a heater 12 constituting an infrared image furnace, the sample was continuously stirred by rotating the reaction tube 10 around a horizontal axis by means of a motor 13. In this state, an oxygen-containing gas was introduced into the reaction tube from the right end and discharged from the left end, in which state an oxygen-containing plasma was generated by a high frequency coil 14 under the conditions shown in Table 3, whereby the sample 11 was subjected to selective oxidation treatment by oxygen-containing plasma. The positive ion density of the oxygen-containing plasma was measured using tungsten probes 15.

The internal-oxidized alloy in the form of particles thus obtained were sintered by a hot press method under the conditions that the temperature was 23° K., the pressure was 120 kg/cm$^2$ and the period of time was 10 minutes, to obtain a cylindrical shaped article of 150 mm in length and 2 mm in diameter.

Figure 3:
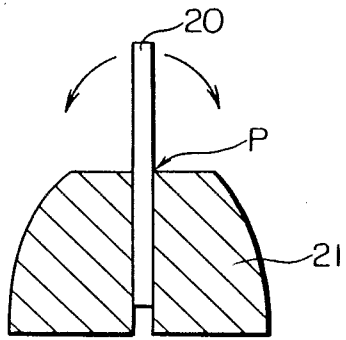
FIG. 3 shows a method of fixing a sample in the 90° reciprocal bending test for a shaped article of this invention.

This shaped article was evaluated by a 90°-reciprocal bending test. In the test, as shown in FIG. 3, each sample 20 was fixed by a vise 21 so that one end of the sample 20 projected from a point P of the vise 21 by 50 mm; the sample 20 was slowly and continuously bent alternately to the right and to the left each by 90°; and there was measured the number of reciprocal bendings until cracks appeared at the portion of the sample near the point P of the vise. The results are shown in Table 3.

Comparative Example 3

The same particles as in Example 3 were sintered without being subjected to selective oxidation treatment by oxygen-containing plasma. The cylindrical shaped article obtained was evaluated by the same method as in Example 3. The results are shown in Table 3.

TABLE 3

| | Run No. | Oxygen containing gas Kind | Flow* rate | Pressure (mTorr) | Electric energy for discharge (W) | Positive ion density (positive ions/cm$^3$) | 90°-Reciprocal bending test (number of bendings) |
|---|---|---|---|---|---|---|---|
| Example 3 | 1 | $O_2$ | 0.1 | 5 | 10 | $6 \times 10^6$ | 6 |
| | 2 | $O_2$ | 0.1 | 5 | 50 | $7 \times 10^7$ | 10 |

TABLE 3-continued

| | Run No. | Oxygen containing gas Kind | Oxygen containing gas Flow* rate | Pressure (mTorr) | Electric energy for discharge (W) | Positive ion density (positive ions/cm$^3$) | 90°-Reciprocal bending test (number of bendings) |
|---|---|---|---|---|---|---|---|
| | 3 | $O_2$ | 0.1 | 5 | 100 | $4 \times 10^8$ | 8 |
| | 4 | $O_2$ | 0.1 | 5 | 300 | $6 \times 10^9$ | 4 |
| | 5 | $CO_2$ | 0.1 | 10 | 10 | $4 \times 10^6$ | 7 |
| | 6 | $CO_2$ | 0.1 | 10 | 50 | $5 \times 10^7$ | 10 |
| | 7 | $CO_2$ | 0.1 | 10 | 100 | $3 \times 10^8$ | 9 |
| | 8 | $CO_2$ | 0.1 | 10 | 300 | $2 \times 10^9$ | 4 |
| Comparative Example 3 | 9 | — | — | — | — | — | 2 |

Note:
*Unit: cc (STP)/min

Example 4 and Comparative Example 4

Figure 4:
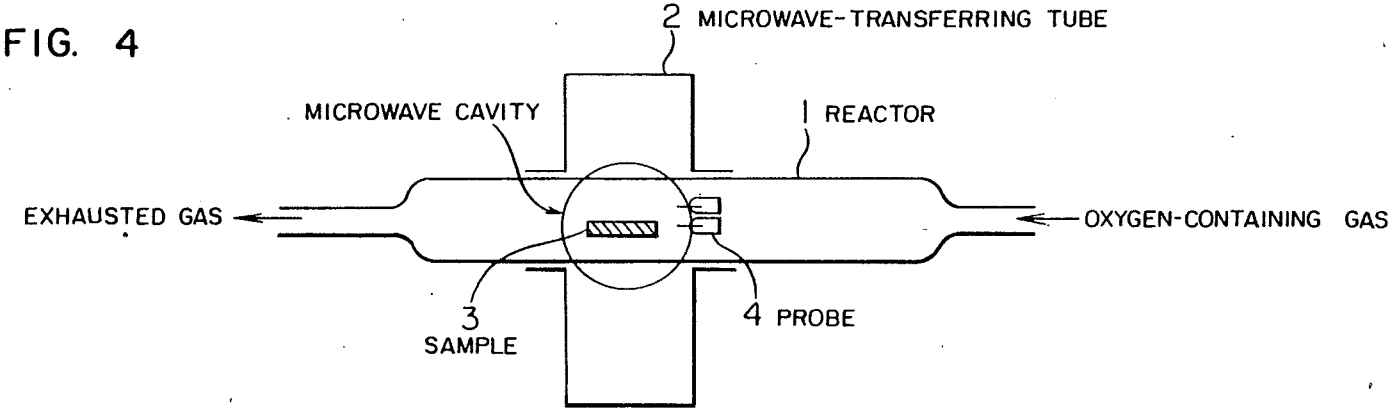
FIG. 4 shows another example of the plasma generator used in this invention.

A plate of 50 mm in length, 5 mm in width and 200 μm in thickness, composed of a Cu-Al alloy (Al content: 1.0% by weight, melting point: 1358° K.) prepared by a melting method was used as a sample. In a plasma-generator having the structure shown in FIG. 4 in which a microwave-transferring tube was used, said sample 3 was placed at the position of a cavity 2 of a 3-liter quartz reaction tube 1, and kept so as to enable the induction heating of the sample.

Then, the conditions for an oxygen-containing gas to be fed to the reaction tube 1, the oxygen-containing plasma-generating conditions and the induction heating temperature were selected as shown in Table 4, and the sample was subjected to selective oxidation treatment by the oxygen-containing plasma and induction heating for 2 hours, whereby an internal-oxidized alloy was produced.

The internal-oxidized alloy was cut by a cutter. The cut section was polished and corroded with a $FeCl_3$-corroding solution (anhydrous $FeCl_3$ 5 g+hydrochloric acid 2 cc+ethanol 96 cc), after which the corroded section was observed under a metallurgical microscope. The internal-oxidized areas were seen as brown spots, which enabled the measurement of the thickness of the internal-oxidized layer.

The internal-oxidized layer was subjected to measurement of Vickers hardness using a micro Vickers hardness tester "MVK-1" manufactured by Akashi Seisakusho, and of tensile yield strength using an autograph "DSS-500" manufactured by Shimadzu Corp. The autograph was one remodelled so as to enable high temperature heating by an infrared image furnace, and the tensile yield strength was measured by fixing a sample to the chuck of the autograph and then elevating the sample temperature to 673° K. The results are shown in Table 4. In Table 4, Run No. 18 is Comparative Example 4, in which no internal oxidation was conducted.

TABLE 4

| Run No. | Oxygen-containing gas Kind | Oxygen-containing gas Flow rate*1 | Carrier gas Kind | Carrier gas Flow rate*1 | Pressure (Torr) | Electric energy for microwave discharge*2 (W) | Positive*3 ion density (positive ions/cm$^3$) | Induction heating temperature (°K.) | Thickness of internally oxidized layer (μm) | Vickers hardness (Kg/mm$^2$) | Tensile yield strength (kg/mm$^2$) |
|---|---|---|---|---|---|---|---|---|---|---|---|
| 1 | $O_2$ | 2 | — | — | $2 \times 10^{-2}$ | 350 | $6 \times 10^6$ | 843 | 135 | 165 | 10.4 |
| 2 | $O_2$ | 2 | — | — | $2 \times 10^{-2}$ | 420 | $5 \times 10^8$ | 903 | 185 | 190 | 11.9 |
| 3 | $O_2$ | 2 | — | — | $2 \times 10^{-2}$ | 500 | $7 \times 10^{10}$ | 973 | 200 | 200 | 12.7 |
| 4 | $O_2$ | 2 | — | — | $2 \times 10^{-2}$ | 800 | $2 \times 10^{11}$ | 1173 | 200 | 200 | 12.5 |
| 5 | $CO_2$ | 2 | — | — | $5 \times 10^{-2}$ | 380 | $7 \times 10^6$ | 833 | 145 | 170 | 10.5 |
| 6 | $CO_2$ | 2 | — | — | " | 430 | $7 \times 10^8$ | 933 | 190 | 185 | 11.3 |
| 7 | $CO_2$ | 2 | — | — | " | 520 | $4 \times 10^{10}$ | 983 | 200 | 198 | 13.1 |
| 8 | $NO_2$ | 1 | — | — | $6 \times 10^{-2}$ | 350 | $8 \times 10^6$ | 853 | 150 | 172 | 10.4 |
| 9 | $NO_2$ | 1 | — | — | " | 450 | $5 \times 10^8$ | 923 | 180 | 194 | 11.7 |
| 10 | $NO_2$ | 1 | — | — | " | 500 | $5 \times 10^{10}$ | 993 | 200 | 208 | 12.9 |
| 11 | $O_2$ | 1 | $N_2$ | 20 | 2 | 370 | $4 \times 10^6$ | 823 | 140 | 180 | 10.6 |
| 12 | $O_2$ | 1 | $N_2$ | 20 | 2 | 440 | $6 \times 10^8$ | 913 | 193 | 196 | 11.5 |
| 13 | $O_2$ | 1 | $N_2$ | 20 | 2 | 510 | $3 \times 10^{10}$ | 1003 | 200 | 200 | 12.9 |
| 14 | $O_2$ | 1 | $N_2$ | 20 | 2 | 820 | $7 \times 10^{11}$ | 1158 | 200 | 200 | 12.3 |
| 15 | $O_2$ | 1 | He | 20 | 5 | 350 | $4 \times 10^6$ | 833 | 128 | 169 | 10.6 |
| 16 | $O_2$ | 1 | He | 20 | 5 | 460 | $7 \times 10^8$ | 923 | 182 | 187 | 11.8 |
| 17 | $O_2$ | 1 | He | 20 | 5 | 520 | $6 \times 10^{10}$ | 988 | 200 | 200 | 13.2 |
| 18 | — | — | — | — | — | — | — | 298 | 0 | 63 | 3.1 |

Note:
*1Unit: cc(STP)/min
*2Electric source: AC source of 2450 MHz
*3Measurement was made by a probe method, and calculation was made in accordance with a Malter-Webster method ["RCA Review" (1951), 12, 191].

EXAMPLE 5

Figure 5:
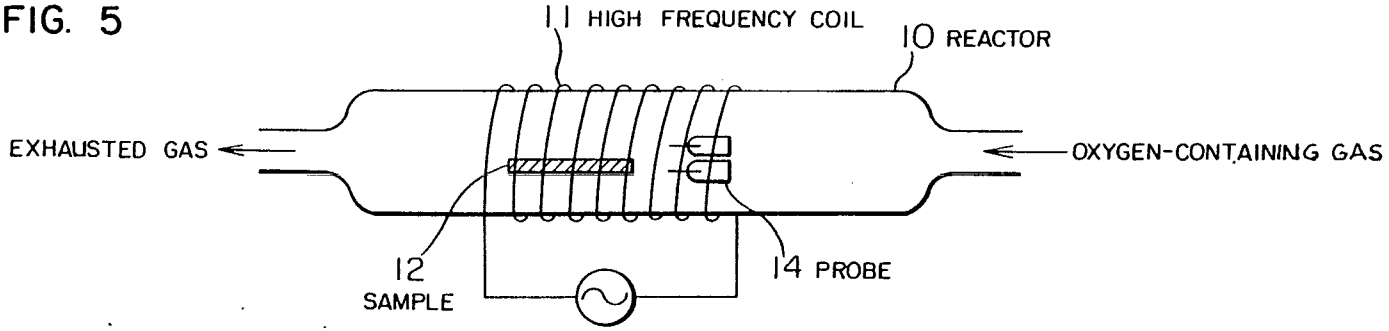
FIG. 5 shows still another example of the plasma generator used in this invention.

In an induction coupling plasma generator of tubular flow type having the structure shown in FIG. 5, the same sample 12 as in Example 4 was placed at the position of a high frequency coil 11 in 5-liter quartz reaction tube 10. The conditions for an oxygen-containing gas were selected as shown in Table 5, and an oxygen-containing plasma was generated by the high frequency coil 11 while conducting induction heating, whereby the sample was subjected to selective oxidation treatment for 2 hours, to produce an internal-oxidized alloy.

The internal-oxidized alloy was subjected to the same evaluation as in Example 1.

The results are shown in Table 5.

Comparative Example 5

The same sample as in Example 4 was subjected to selective oxidation treatment for 2 hours at an induction heating temperature of 973° K. according to the conventional process in the state that an internal-oxidizing agent, consisting of a mixed powder of $Cu_2O$ and Cu having an average particle diameter of 100 μm was contacted around the same sample as in Example 4, whereby an internal-oxidized alloy was produced. This internal-oxidized alloy was subjected to the same evaluation as in Example 4. The results obtained are shown in Table 5.

TABLE 5

| | Run No. | Oxygen-containing gas Kind | Oxygen-containing gas Flow rate*1 | Carrier gas Kind | Carrier gas Flow rate*1 | Pressure (Torr) | Electric energy*2 for high frequency discharge (W) |
|---|---|---|---|---|---|---|---|
| Example 5 | 1 | $O_2$ | 2 | — | — | $5 \times 10^{-2}$ | 370 |
| | 2 | $O_2$ | 2 | — | — | " | 450 |
| | 3 | $O_2$ | 2 | — | — | " | 520 |
| | 4 | $O_2$ | 1 | $N_2$ | 20 | 1 | 340 |
| | 5 | $O_2$ | 1 | $N_2$ | 20 | " | 440 |
| | 6 | $O_2$ | 1 | $N_2$ | 20 | " | 500 |
| Comparative Example 5 | 7 | — | — | — | — | — | — |

| | Run No. | Position ion density (positive ions/cm³) | Induction heating temperature (°K.) (μm) | Thickness of internally oxidized layer (kg/mm²) | Vickers hardness (kg/mm²) | Tensile yield strength |
|---|---|---|---|---|---|---|
| Example 5 | 1 | $5 \times 10^6$ | 853 | 151 | 171 | 10.5 |
| | 2 | $3 \times 10^8$ | 898 | 191 | 187 | 11.2 |
| | 3 | $9 \times 10^1$ | 963 | 200 | 199 | 12.4 |
| | 4 | $7 \times 10^6$ | 848 | 142 | 167 | 10.8 |
| | 5 | $6 \times 10^8$ | 903 | 189 | 191 | 11.1 |
| | 6 | $8 \times 10^9$ | 953 | 200 | 196 | 12.5 |
| Comparative Example 5 | 7 | — | 973*4 | 5 | 70 | 3.3 |

Note:
*1Unit: cc(STP)/min
*2Electric source: AC sources of 13.56 MHz
*3Measurement was made by a probe method, and calculation was made in accordance with a Malter-Webster method ["RCA Review" (1951), 12, 191].
*4Heating by an electric furnace.

EXAMPLE 6

Figure 6:
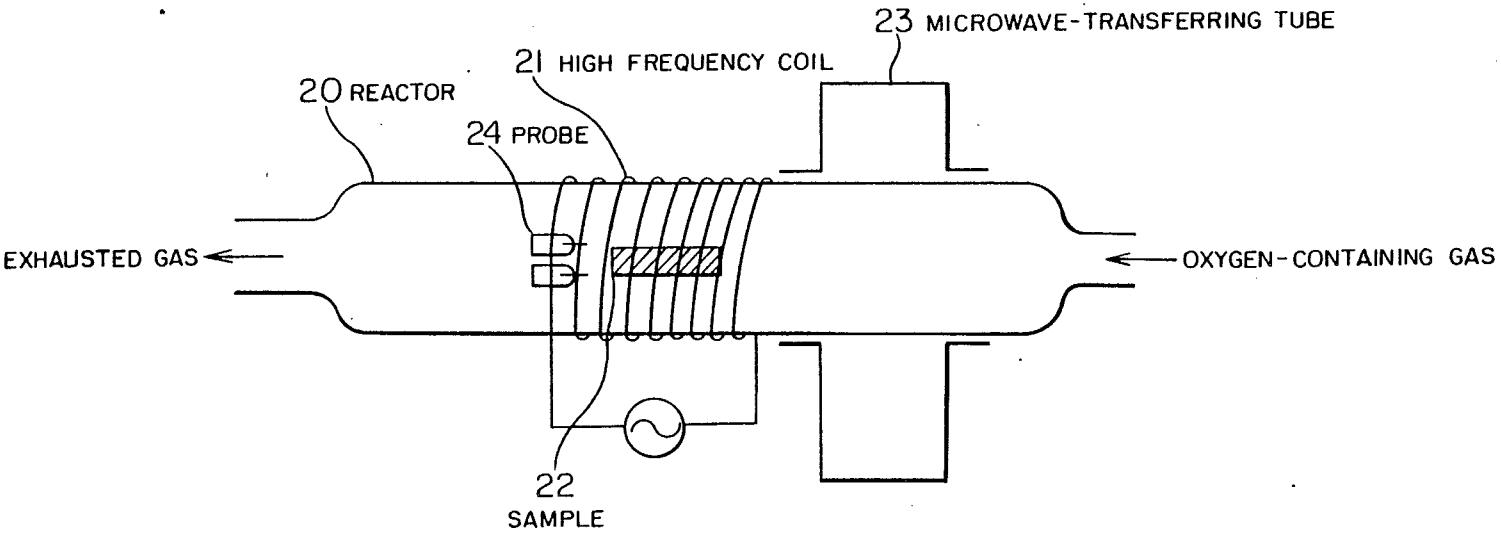
FIG. 6 shows a further example of the plasma generator used in this invention.

In a plasma generator having the structure shown in FIG. 6 in which a microwave plasma generator using a microwave-transferring tube and an induction-heating device by a high frequency coil are provided, the same sample as in Example 4 was placed at the position of the high frequency coil 21 of a 3-liter quartz reaction tube 20. An oxygen-containing plasma was generated by the microwave-transferring tube 23 while keeping the sample temperature at 973° K. by the induction heating by means of the high frequency coil 21, in which state the sample was subjected to selective oxidation treatment by oxygen-containing plasma for 2 hours, to produce an internal-oxidized alloy.

This internal-oxidized alloy was subjected to the same evaluation as in Example 4. The results are shown in Table 6.

EXAMPLE 7

Selective oxidation treatment was conducted in the same manner as in Example 6, except that the sample was heated to 973° K. using an infrared image furnace in place of induction heating by means of a high frequency coil, whereby an internal-oxidized alloy was produced. This internal-oxidized alloy was subjected to the same evaluation as in Example 4. The results are shown in Table 6.

TABLE 6

| | Run No. | Oxygen-containing gas Kind | Oxygen-containing gas Flow rate*1 | Carrier gas Kind | Carrier gas Flow rate*1 | Pressure (Torr) | Electric energy*2 for microwave discharge (W) |
|---|---|---|---|---|---|---|---|
| Example 6 | 1 | $O_2$ | 2 | — | — | $2 \times 10^{-2}$ | 510 |
| | 2 | $O_2$ | 1 | $N_2$ | 20 | 2 | 530 |
| Example 7 | 3 | $O_2$ | 2 | — | — | $2 \times 10^{-2}$ | 500 |
| | 4 | $O_2$ | 1 | $N_2$ | 20 | 2 | 510 |

| | Run No. | Positive ion density (positive ions/cm³) | Electric energy*4 for high frequency heating (W) | Thickness of internally oxidized layer (μm) | Vickers hardness (kg/mm²) | Tensile yield strength (kg/mm²) |
|---|---|---|---|---|---|---|
| Example | 1 | $2 \times 10^{10}$ | 200 | 200 | 199 | 12.2 |

TABLE 6-continued

| | | | | | | |
|---|---|---|---|---|---|---|
| 6 | 2 | $4 \times 10^{10}$ | 200 | 200 | 201 | 12.1 |
| Example | 3 | $3 \times 10^{10}$ | — | 70 | 170 | 6.6 |
| 7 | 4 | $1 \times 10^{10}$ | — | 80 | 164 | 6.3 |

Note:
*1Unit: cc(STP)/min
*2Electric source: AC source of 2450 MHz
*3Measurement was made by a probe method, and calculation was made in accordance with a Malter-Webster method ["RCA Review" (1951), 12, 191].
*4Electric source: AC source of 400 KHz.

EXAMPLE 8

A plate of 50 mm in length, 5 mm in width and 1 mm in thickness composed of a Fe-Si alloy (Si content: 0.3% by weight, melting point: 1808° K.) prepared by a melting method was used as a sample. In an apparatus having the constitution shown in FIG. 4, the sample was subjected to selective oxidation treatment by an oxygen-containing plasma for 10 hours under the conditions that the induction heating temperature was 0.5 tm (904° K.), 0.6 tm (1084° K.) or 0.7 tm (1266° K.) (Tm: the melting point of the sample), the flow rate of oxygen gas was 40 cc (STP)/min, the pressure of oxygen gas was 20 mTorr and the positive ion density was $5 \times 10^{10}$ positive ions/cm$^3$, whereby an internal-oxidized alloy was produced.

The internal-oxidized alloy was cut with a diamond cutter. The cut section was polished and then observed using a metallurgical microscope at a magnification of 1,000. The internal-oxidized areas were seen as block spots, which enabled the measurement of the thickness of the internal-oxidized layer. The results are shown in Table 7.

Comparative Example 6

The same sample as in Example 8 was subjected to selective oxidation treatment at the same temperature as in Example 8, namely, 0.5 tm, 0.6 tm or 0.7 tm, for 10 hours according to the conventional process using, as an internal-oxidizing agent, a $Fe_2O_3$powder having an average particle diameter of 30 μm, whereby an internal-oxidized alloy was produced. On this alloy, the thickness of the internal-oxidized layer was measured in the same manner as in Example 8. The results are shown in Table 7.

EXAMPLE 9

Internal-oxidized alloys were produced in the same manner as in Example 8, except that infrared rays-heating was employed in place of the induction heating. The results are shown in Table 7.

TABLE 7

| Temperature | 0.5 Tm | 0.6 Tm | 0.7 Tm |
|---|---|---|---|
| Example 8 | 65 μm | 170 μm | 550 μm |
| Comparative Example 6 | 2 μm | 8 μm | 20 μm |
| Example 9 | 45 μm | 110 μm | 350 μm |

EXAMPLE 10

Particles having an average diameter of 3 μm composed of a Cu-Al alloy (Al content: 0.01% by weight, melting point: 1358° K.) were obtained by mechanically grinding an alloy block prepared by a melting method using an eddy mill.

Figure 7:
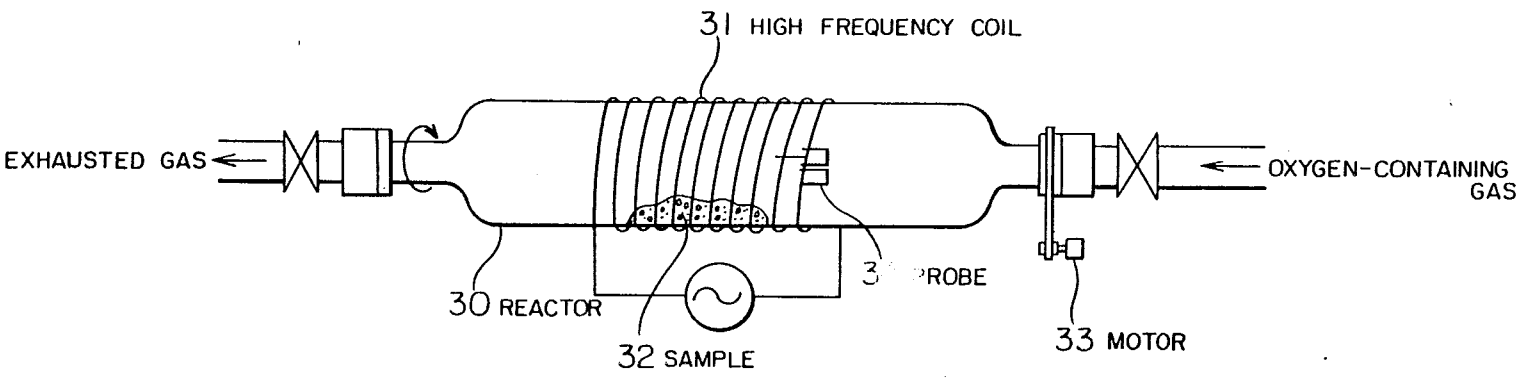
FIG. 7 is a still further example of the plasma generator used in this invention.

In a plasma generator having the structure shown in FIG. 7, said powder sample 32 was placed at the position of a high frequency coil 31 of a 5-liter quartz reaction tube 30. While the reaction tube 30 was rotated around its horizontal axis by a motor 33 to stir the sample, an oxygen-containing gas was fed into the reaction tube 30 from the right end and discharged from the left end. In this state, an oxygen-containing plasma was generated by the high frequency coil 31 under the conditions shown in Table 8 and allowed to act on the sample heated to 973° K. by induction heating, whereby the selective oxidation treatment of the sample was conducted.

The internal-oxidized alloy thus obtained in the form of particles was sintered according to a hot press method at 923° K. at 120 kg/cm$^2$ for 10 min to prepare a cylindrical shaped article of 150 mm in length and 2 mm in diameter.

This shaped article was subjected to measurement of the number of reciprocal bendings according to the same bending test as in Example 3, using the vise 41 shown in FIG. 3. The results obtained are shown in Table 8.

Comparative Example 7

The same particles as in Example 10 were sintered without being subjected to selective oxidation treatment by oxygen-containing plasma. The shaped article obtained was subjected to measurement of the number of reciprocal bendings in the same manner as in Example 10. The results are shown in Table 8.

TABLE 8

| | Run No. | Oxygen-containing gas Kind | Oxygen-containing gas Flow rate*1 | Carrier gas Kind | Carrier gas Flow rate*1 | Pressure (Torr) | Electric energy*2 for high frequency discharge (W) | Positive ion density (positive ions/cm$^3$) | 90°-Reciprocal bending test (number of bendings) |
|---|---|---|---|---|---|---|---|---|---|
| Example 10 | 1 | $O_2$ | 2 | — | — | $2 \times 10^{-2}$ | 330 | $4 \times 10^7$ | 9 |
| | 2 | $O_2$ | 2 | — | — | $2 \times 10^{-2}$ | 510 | $6 \times 10^9$ | 10 |
| | 3 | $CO_2$ | 1 | — | — | $1 \times 10^{-2}$ | 310 | $7 \times 10^7$ | 9 |
| | 4 | $CO_2$ | 1 | — | — | $1 \times 10^{-2}$ | 520 | $2 \times 10^9$ | 10 |
| | 5 | $NO_2$ | 2 | — | — | $5 \times 10^{-2}$ | 300 | $3 \times 10^7$ | 9 |
| | 6 | $NO_2$ | 2 | — | — | $5 \times 10^{-2}$ | 490 | $3 \times 10^9$ | 10 |
| | 7 | $O_2$ | 1 | $N_2$ | 20 | 2 | 330 | $6 \times 10^7$ | 9 |
| | 8 | $O_2$ | 1 | $N_2$ | 20 | 2 | 520 | $4 \times 10^9$ | 10 |
| | 9 | $O_2$ | 1 | He | 20 | 5 | 310 | $5 \times 10^7$ | 9 |

TABLE 8-continued

| | Run No. | Oxygen-containing gas Kind | Oxygen-containing gas Flow rate*1 | Carrier gas Kind | Carrier gas Flow rate*1 | Pressure (Torr) | Electric energy*2 for high frequency discharge (W) | Positive ion density (positive ions/cm$^3$) | 90°-Reciprocal bending test (number of bendings) |
|---|---|---|---|---|---|---|---|---|---|
| | 10 | $O_2$ | 1 | He | 20 | 5 | 500 | $7 \times 10^9$ | 10 |
| Comparative Example 7 | 11 | — | — | — | — | — | — | — | 3 |

Note:
*1Unit: cc(STP)/min
*2Electric source: AC source of 13.56 MHz

What is claimed is:

1. A process for producing an internal-oxidized alloy, which comprises allowing a plasma generated in the presence of oxygen, a gas of an oxygen atom-containing compound or a mixture of oxygen and a gas of an oxygen atom-containing compound to act on an alloy consisting of at least two metal elements, thereby selectively oxidizing at least one metal element other than the matrix metal in said alloy.

2. A process for producing an internal-oxidized alloy according to claim 1, wherein the starting alloy is heated by induction heating when the plasma is allowed to act thereon.

3. A process for producing an internal-oxidized alloy according to claim 1, wherein the alloy is Ag-Al, Ag-Bi, Ag-Cd, Cu-Al, Cu-Si, Cu-Ti, Fe-Si, Fe-Mo, Fe-Ti, Ni-Th, Ni-Os or Ni-Ti.

4. A process for producing an internal-oxidized alloy according to claim 1, wherein the starting alloy contains at least one metal element other than the matrix metal in a total amount of 20 ppm to 20% by weight based on the weight of the starting alloy.

5. A process for producing an internal-oxidized alloy according to claim 1, wherein the plasma is generated in the presence of $O_2$, $CO_2$, $NO_2$, $N_2O_3$, $N_2O_4$, $N_2O_5$, $SO_2$, $SO_3$, $TeO_2$, $TeO_3$, $SeO_3$, $P_4O_{10}$, $P_4O_6$, $As_2O_5$, $As_4O_6$, $Sb_2O_5$, $Sb_4O_6$, $Bi_2O_5$, $Bi_4O_6$or $H_2O$.

6. A process for producing an internal-oxidized alloy according to claim 1, wherein the plasma is generated in a space having a degree of vacuum of $1\times10^{-5}$ to 100 Torr.

7. A process for producing an internal-oxidized alloy according to claim 1, wherein the positive ion density of the plasma is $10^5$–$10^{12}$ positive ions/cm$^3$.

8. A process for producing an internal-oxidized alloy according to claim 1, wherein the plasma is allowed to act on the starting alloy at a temperature not higher than the melting point (Tm) of the starting alloy.

9. A process for producing a shaped article of an internal-oxidized alloy, which comprises allowing a plasma generated in the presence of oxygen, a gas of an oxygen atom-containing compound or a mixture of oxygen and an oxygen atom-containing compound to act on an alloy in the form of particles consisting of at least two metal elements, thereby selectively oxidizing at least one metal element other than the matrix metal, and then molding and sintering the internal-oxidized alloy in the form of particles thus obtained.

10. A process for producing an internal-oxidized alloy according to claim 9, wherein the particles of the alloy have an average diameter of 50 Å to 100 μm.

* * * * *